United States Patent [19]

Hanano

[11] Patent Number: 5,052,466

[45] Date of Patent: Oct. 1, 1991

[54] ATOMIZER FOR FEEDING MOLD RELEASE AGENT IN A DIE CASTING MACHINE

[75] Inventor: Takashi Hanano, Kobe, Japan

[73] Assignee: Hanano Corporation, Kobe, Japan

[21] Appl. No.: 407,999

[22] Filed: Sep. 15, 1989

[30] Foreign Application Priority Data

Sep. 26, 1988 [JP] Japan ..... 63-240534

[51] Int. Cl.[5] ..... B22D 17/00

[52] U.S. Cl. ..... 164/267; 164/150; 164/312

[58] Field of Search ..... 164/72, 267, 312, 150

[56] References Cited

U.S. PATENT DOCUMENTS 3,920,099 11/1975 Pondelicek et al. ..... 164/72

4,770,225 9/1988 Takagi et al. ..... 164/267

FOREIGN PATENT DOCUMENTS 3422068 12/1985 Fed. Rep. of Germany ..... 164/267

*Primary Examiner*—Richard K. Seidel

*Assistant Examiner*—Edward A. Brown

*Attorney, Agent, or Firm*—Armstrong, Nikaido, Marmelstein, Kubovcik & Murray

[57] ABSTRACT

An atomizer having a mold release agent passage and a pressure air passage that sprays misty mold release agent by mixing mold release agent coming from the mold release agent passage with pressure air coming from the pressure air passage. A rotor having plural vanes is installed in a course of a mold release agent passage of the atomizer in such a way that the vanes are subjected to a pressure of the mold release agent passing through the mold release agent passage and are rotated by the mold release agent, and a rotating speed sensor for detecting a rotating speed of the rotor is installed therein.

1 Claim, 2 Drawing Sheets

ATOMIZER FOR FEEDING MOLD RELEASE AGENT IN A DIE CASTING MACHINE

BACKGROUND OF THE INVENTION

Industrial useful field

This invention relates to an atomizer which feeds misty mold release agent onto inside surfaces of diecasting dies installed in a diecasting machine.

Prior art and its problem

Generally, mold release agent (lubricant) is sprayed onto inside surfaces of diecasting dies in order to ease removal of diecast products from the dies when manufacturing diecast products. In this instance, too excessive or too insufficient spray quantity of mold release agent is not preferable because temperature of die will vary due to fluctuation of spray quantity. Especially, too insufficient quantity would cause seizure of diecast products to the diecasting die. Therefore, it is required for the atomizer to always detect the spray quantity of mold release agent and to take measures such as shutting down of the atomizer etc. in the event of insufficient spray quantity.

In conventional atomizers, however, a mechanism for detecting the spray quantity of mold release agent has not been installed.

SUMMARY OF THE INVENTION

The applicant of this invention worked out a way of detecting a flow quantity or a spray quantity of mold release agent passing through an atomizer by installing a flow meter in an outside piping for mold release agent of the atomizer. However, this method included disadvantages that clogging of mold release agent at the tip portion of the piping might not be detected and therefore a properness of the spray quantity of mold release agent could not be estimated surely, and further a piping structure became complicated.

In this invention, in order to provide an atomizer which can always detect a spray quantity of mold release agent surely; a rotor having plural vanes is installed in a course of a mold release agent passage of the atomizer in such a way that the vanes are subjected to a pressure of the mold release agent passing through the mold release agent passage to be rotated thereby, and a rotating speed sensor for detecting a rotating speed of the rotor is installed therein.

In the case when a quantity of the mold release agent passing through the mold release agent passage is larger than a proper quantity, the rotor rotates faster than a speed attained by the proper quantity because the vanes of the rotor are subjected to a pressure larger than that generated by the proper quantity. Further, the vanes of the rotor rotate slower than the speed attained by the proper quantity when the quantity of mold release agent is smaller than the proper quantity. Accordingly, it becomes possible from the rotating speed of the rotor to estimate the properness of the flow quantity or spray quantity.

DETAILED DESCRIPTION OF THE INVENTION

Figure 1:
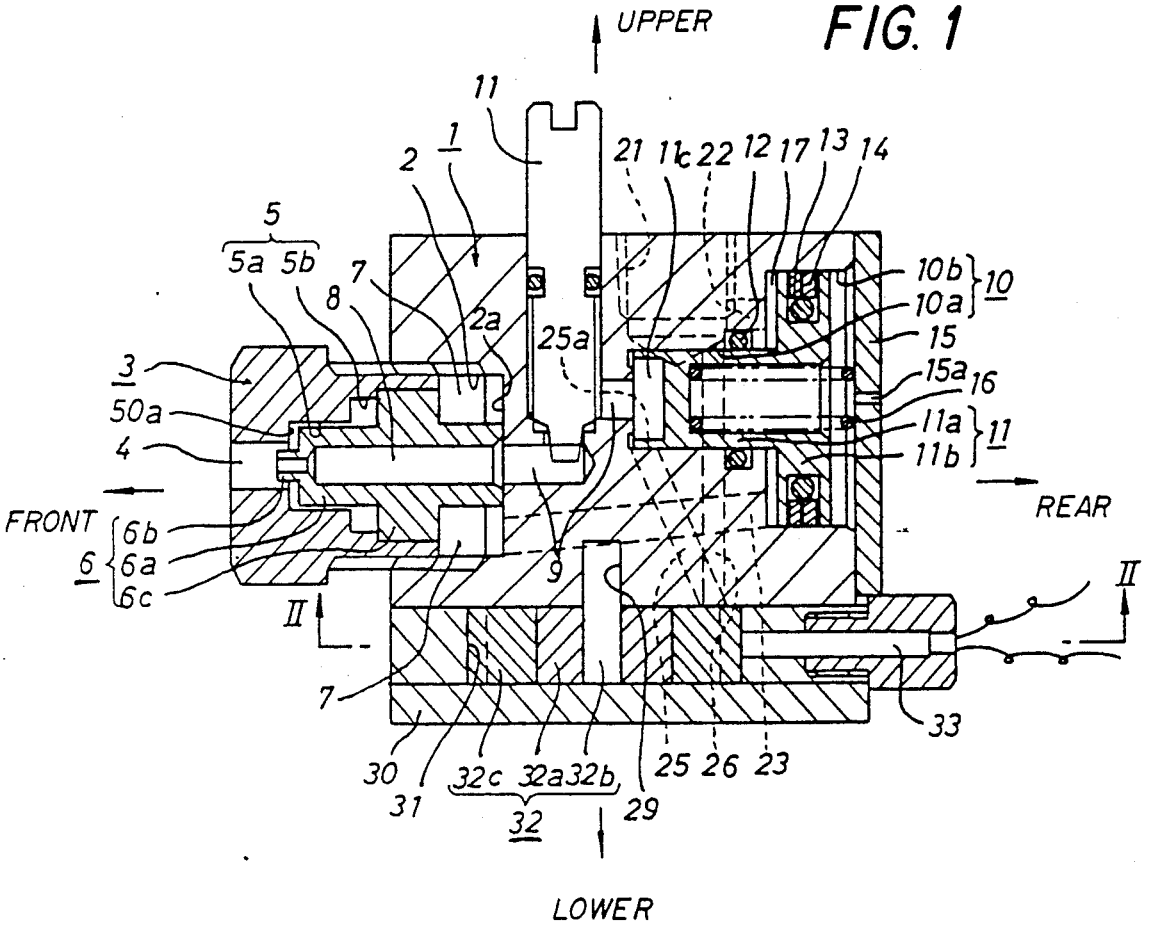
FIG. 1 is a vertical sectional view of the atomizer according to the invention.
Figure 2:
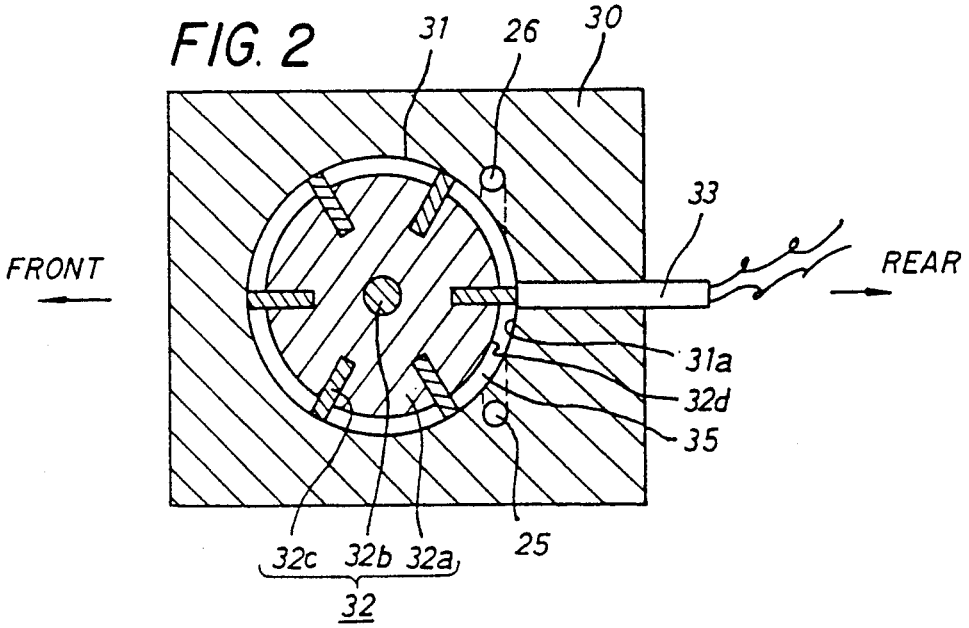
FIG. 2 is a sectional view taken along a line II—II of FIG. 1.
Figure 3:
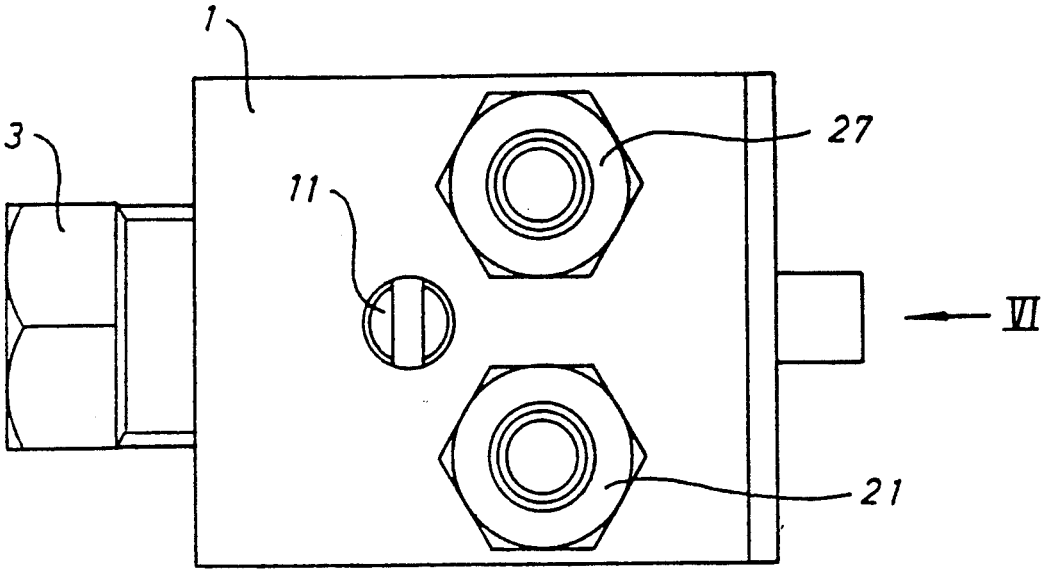
FIG. 3 is a plan view of the atomizer.
Figure 4:
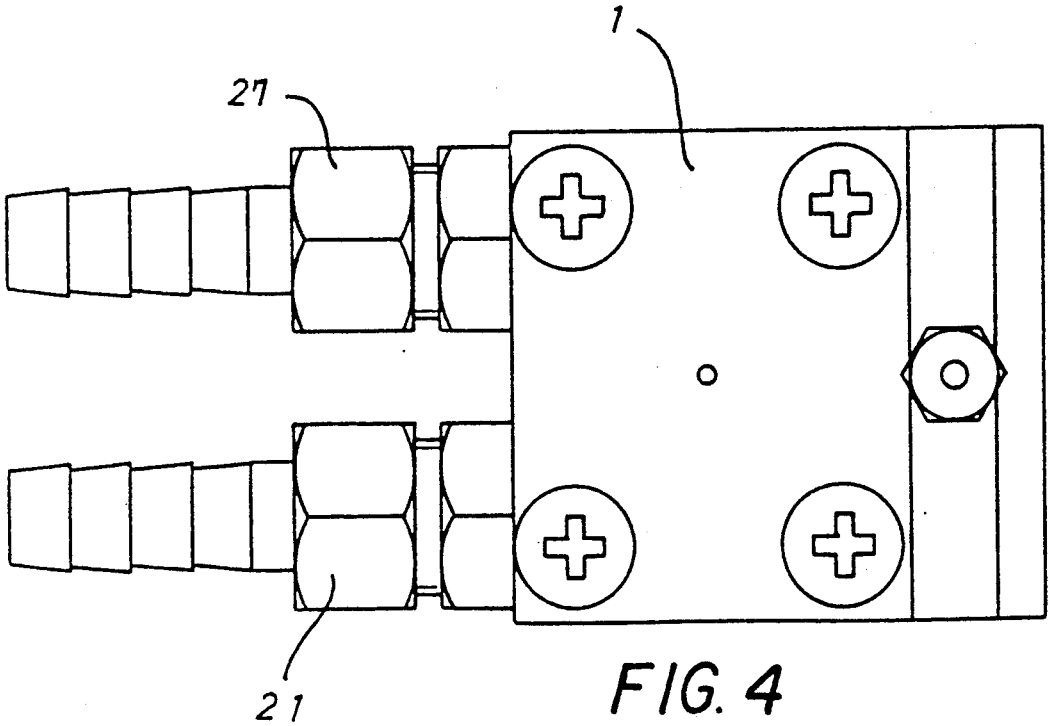
FIG. 4 is a view viewed in a direction of an arrow IV of FIG. 3.

An embodiment of the present invention will be described hereunder with reference to the drawings. FIG. 1 is a vertical sectional view of the atomizer according to the invention, FIG. 2 is a sectional view taken along a line II—II of FIG. 1, FIG. 3 is a plan view of the atomizer, and FIG. 4 is a view viewed in a direction of an arrow IV of FIG. 3. In FIG. 1, a spray nozzle 3 is screwed into a screw hole 2 in front of a holder 1 by a prescribed amount. The nozzle 3 concentrically has a spray port 4 opening to a front end face of the nozzle 3 and a cylinder 5, i.e. a small-dia. cylinder 5*a* and large-dia. cylinder 5*b*.

An agent delivery nozzle 6 fits in the cylinder 5. The nozzle 6 is composed of a nozzle body 6*a* having a diameter which is slightly smaller than the small-dia. cylinder 5*a* and a length which is slightly shorter than a length from a front end face 50*a* of the cylinder 5*a* to a rear end face 2*a* of the screw hole 2 as shown in FIG. 1, a protruding portion 6*b* which has a diameter smaller than the spray port 4 and is formed so as to protrude from a front end face of the nozzle body 6*a*, and a flange portion 6*c* which spline fits in the large-dia. cylinder 5*b*. The nozzle 6 is in a state where the flange portion 6*c* spline fits in the large-dia. cylinder 5*b*, a rear end face of the body 6*a* comes closely into contact with the rear end face 2*a* of the screw hole 2, and a front part of the protruding portion 6*b* enters the spray port 4. A chamber 7 intercommunicates to the spray port 4 to permit air to pass therebetween; through means of a clearance (not shown) between spline teeth of the flange portion 6*c*, a clearance between the body 6*a* and walls of the cylinders 5*a* and 5*b*, and a clearance between the protruding portion 6*b* and a wall of the spray port 4.

Further, the nozzle 6 includes a first mold release agent passage 8 at its center, and the passage 8 opens to a front end face of the protruding portion 6*b* at its front and to a rear end face of the body 6*a* at its rear. The passage 8 intercommunicates to a piston chamber 10 through a second mold release agent passage 9. A mold release agent control needle valve 11 is installed in a course of the passage 9. The piston chamber 10 is composed of a small-dia. piston chamber 10*a* communicating to the passage 9 and a large-dia. piston chamber 10*b*. The piston valve fits in the piston chamber 10. The valve 11 is composed of a small-dia. valve 11*a* fitting in the small-dia. piston chamber 10*a* and a large-dia. valve 11*b* fitting, in the large-dia. piston chamber 10*b*; in which the small-dia. valve 11*a* fits in the piston chamber 10*a* through an "O" ring 12 and the large-dia. valve 11*b* fits in the piston chamber 10*b* through an "O" ring 13 and an outer peripheral piston ring 14.

The valve 11 is urged forward by a compression spring 16 compressedly installed between a cap 15 and the valve 11, so that a front end face of the small-dia. valve 11*a* comes into close contact with a front end face of the small-dia. piston chamber 10*a*. In this instance, a clearance 17 is provided between a front end face of the large-dia. valve 11*b* and a front end face of the large-dia. piston chamber 10*b*. A major portion of the compression spring 16 is incorporated in the valve 11. Further, a recession 11*c* having a larger diameter than that of the passage 9 is formed on a front end face of the small-dia.

valve 11*a*. Moreover, the cap 15 has an air hole 15*a* at its center.

A first air passage 22 communicating to a pressure air solenoid valve 21 opens to an upper side of the front end face of the large-dia. piston chamber 10*b*. Further, a second air passage 23 communicating to the chamber 7 opens a lower side of the front end face thereof.

An upwardly opening rotor case 30 has a cylindrical chamber 31, and is fastened to a lower surface of the holder 1 so as to enclose the chamber 31. A rotor 32 is installed in the chamber 31. The rotor 32 is composed of a cylindrical body 32*a* having a diameter slightly smaller than that of the chamber 31, a rotating shaft 32*b* located at a center of the cylindrical body 32*a*, and flat square metal vanes 32*c* provided at plural places on a side wall 32*d* of the cylindrical body 32*a* with equal spaces left therebetween in a circumferential direction. The rotating shaft 32*b* is rotatably inserted at its top end into a perpendicular hole 29 made on the lower surface of the holder 1.

As illustrated in FIG. 2, a clearance 35 between the side wall 31*a* of the chamber 31 and the side wall 32*d* of the cylindrical body 32*a* is partitioned by the vanes 32*c* to form individually independent spaces. Further, a sensor 33 which counts the number of vanes 32*c* passing through it utilizing a rotation of the rotor 32, is fitted to a specified place of the side wall 31*a* of the chamber 31. The sensor 33 is a device for counting the number of vanes 32*c* passing a front of the sensor utilizing, for example, an action of the vane 32*c* intercepting light emitted from a tip end of the sensor 33.

Moreover, ends of a third mold release agent passage 25 and a fourth mold release agent passage 26 open to the side wall 31*a* of the chamber 31 respectively at places opposing each other with the sensor 33 put therebetween. A distance between the openings is longer than a distance between tip ends of the adjoining vanes 32*c* of the rotor 32. The other end of the passage 25 opens to a front side wall of the small-dia. piston chamber 10*a*, and this opening 25*a* is shut off by the small-dia. valve 11*a* under normal condition. The passage 26 communicates with the mold release agent solenoid valve 27 (FIG. 3). Incidentally, a rigidity of the compression spring 16 is so set that, when pressure air is led in the clearance 17, the valve 11 moves backward to open the opening 25*a* provided on the side wall of the small-dia. piston chamber 10*a* of the passage 25.

Function will be described hereunder. FIG. 1 shows a normal operating state. Namely, the solenoid valve 21 is closed, the valve 11 is urged forward by the compression spring 16, and the opening 25*a* of the passage 25 is shut off by the small-dia. valve 11*a*.

The atomizer functions as follows until mold release agent is sprayed. When the solenoid valve 21 receives an external signal for it to be at an opening state, pressure air is directed into the clearance 17 through the passage 22 to push the valve 11 backward against the compression spring 16. Thereby, the opening 25*a* of the passage 25 is opened. In this instance, the pressure air is directed into the clearance 17 and enters the chamber 7 through the passage 23 to be sprayed into the spray port 4. The opening 25*a* of the passage 25 is opened so that mold release agent coming from the solenoid valve 27 flows through the passage 26, the clearance 35, the passage 25, the small-dia. piston chamber 10*a*, the passage 9 and the passage 8 to be sprayed into the spray port 4 from the protruding portion 6*c*. The mold release agent sprayed into the spray port 4 is absorbed and mixed to become atomized particles by air flow which is sprayed from the chamber 7 through the clearance into the spray port 4 to be suddenly expanded by pressure reduction, thus being sprayed from the spray port 4 in a misty state.

The mold release agent flowing from the passage 26 through the clearance 35 into the passage 25 exerts a pressure on the vanes 32*c* of the rotor 32 to cause the rotor 32 to rotate. Namely, the rotor 32 keeps rotating together with the flow of mold release agent, a number of vanes 32*c* pass through a front of the sensor 33, thus the number of passed vanes being counted by the sensor 33. Assuming that the number of passed vanes 32*c* within a specified time for a proper flow quantity of agent is n (natural number), the number of passed vanes becomes larger than n for a flow quantity larger than the proper flow quantity because the pressure exerted on the vanes 32*c* is large, and the number of passed vanes becomes smaller than n for a flow quantity smaller than the proper one. Consequently, the detection of the number of passed vanes enables the estimation of the properness of the flow quantity, or the spray quantity, of the mold release agent.

As described above, in the atomizer according to the present invention, the rotor 32 having the plural vanes 32*c* is installed in such a way that the vanes 32*c* are subjected to the pressure of the mold release agent passing from the fourth mold release agent passage 26 to the third mold release agent passage 25 to be rotated thereby, and the number of vanes 32*c* passing the prescribed one point is detected by the sensor 33 through means of the rotation of the rotor 32; so that the properness of spray quantity of mold release agent can always be estimated and absolutely surely at that. Namely, in case for example when the flow quantity of mold release agent is detected by installing the flow meter in the outside piping for mold release agent of the atomizer, the clogging of mold release agent at tip portion of the piping might not be detected and therefore the properness of the spray quantity of mold release agent could not be estimated surely. However, the rotor 32 is installed between the fourth mold release agent passage 26 and the third mold release agent passage 25 within the atomizer so as to detect the flow quantity from the passage 26 to the passage 25, in the present invention; so that even the clogging of mold release agent at tip end of the external piping can be detected and therefore the properness of spray quantity of mold release agent can be estimated surely. Further, since the rotor 32 and the sensor 33 are fitted integrally to the holder 1 by using the rotor case 30, complicated construction as encountered when installing the flow meter in the external piping can be avoided.

Therefore, this type of atomizer can prevent occurrence of defective diecasting products which will be produced by shutting down the machine in the event of improper spray quantity of mold release agent Especially in case when four through ten atomizers are attached to the tip end of robot arm to carry out the spraying operation of mold release agent under an unmanned condition, the operation under the unmanned condition may become possible without paying attention to occurrence of off-spec product if such countermeasure is taken that a warning signal is given to shut down the operation in the event of improper flow quantity of mold release agent.

Incidentally, a tachometer may be attached directly to the rotating shaft 32*b* in place of the sensor 33.

What is claimed is:

1. In a die-casting machine including casting dies, an atomizer for feeding mold release agent to said dies having a mold release agent passage and a pressurized air passage for spraying misty mold release agent by mixing mold release agent coming from the mole release agent passage with pressurized air coming from the pressurized air passage, the atomizer comprising: a rotor having a plurality of vanes being installed in the mold release agent passage of the atomizer in such a way that the vanes are subjected to pressure from the mold release agent passing through the mold release agent passage and are rotated; and a rotation speed sensor installed in the rotor for detecting the rotation speed of the rotor.

* * * * *